United States Patent [19]

Bettigole

[11] Patent Number: 4,780,021

[45] Date of Patent: Oct. 25, 1988

[54] EXODERMIC DECK CONVERSION METHOD

[76] Inventor: Neal H. Bettigole, 89 Howard Dr., Old Tappan, N.J. 07675

[21] Appl. No.: 37,894

[22] Filed: Apr. 13, 1987

[51] Int. Cl.[4] ..... E01C 11/18; E01D 19/12

[52] U.S. Cl. ..... 404/72; 404/70; 14/73; 52/514

[58] Field of Search ..... 404/27, 28, 31, 36, 404/43–45, 70, 73, 72, 82; 14/1, 17, 73; 52/514, 741

[56] References Cited

U.S. PATENT DOCUMENTS

| | | | |
|---|---|---|---|
| 185,302 | 12/1876 | Davison | 404/18 |
| 1,033,106 | 7/1912 | Kahn | 52/88 |
| 1,300,439 | 4/1919 | Madison | 404/18 X |
| 1,613,063 | 1/1927 | Stark | 404/70 |
| 1,984,944 | 12/1934 | Piccirilli | 404/34 |
| 2,096,629 | 10/1937 | Farrar et al. | 52/334 X |
| 2,162,742 | 6/1939 | Nagin | 14/73 |
| 2,190,214 | 2/1940 | Nagin | 14/73 X |
| 2,194,146 | 12/1939 | Leguillon | 404/32 |
| 2,437,095 | 3/1948 | Kahr | 114/85 |
| 2,645,985 | 7/1953 | Beebe et al. | 14/73 X |
| 2,880,116 | 3/1959 | Alps et al. | 428/413 |
| 3,110,049 | 11/1963 | Nagin | 14/73 |
| 3,110,981 | 11/1963 | Larner | 52/408 X |
| 3,260,023 | 7/1966 | Nagin | 14/73 X |
| 3,363,379 | 1/1968 | Curran | 52/334 |
| 3,385,181 | 5/1968 | Stoll | 404/70 |
| 3,545,348 | 12/1970 | Anderson | 404/30 |
| 3,645,510 | 2/1972 | Klugman | 261/94 |
| 3,855,747 | 12/1974 | Langan | 52/404 |
| 3,906,571 | 9/1975 | Zetlin | 14/17 |
| 4,102,102 | 7/1978 | Greulich | 14/73 X |
| 4,145,153 | 3/1979 | Fasullo et al. | 404/73 |
| 4,151,025 | 4/1979 | Jacobs | 156/71 |
| 4,168,924 | 9/1979 | Draper et al. | 404/70 |
| 4,201,023 | 5/1980 | Jungbluth | 52/334 |
| 4,244,768 | 1/1981 | Wiechowski et al. | 156/293 |
| 4,282,619 | 8/1981 | Rooney | 14/6 |
| 4,300,320 | 11/1981 | Rooney | 52/173 R |
| 4,531,857 | 7/1985 | Bettigole | 14/73 X |
| 4,531,859 | 7/1985 | Bettigole | 14/73 X |

OTHER PUBLICATIONS

Easco Industrial Products Brochure, entitled: Greulich Bridge Flooring System, 1982.

*Primary Examiner*—Stephen J. Novosad
*Assistant Examiner*—John F. Letchford
*Attorney, Agent, or Firm*—Banner, Birch, McKie & Beckett

[57] ABSTRACT

A method of converting a conventional grid deck to an exodermic deck is disclosed. The method includes the steps of removing existing concrete if the deck is a filled grid. Tertiary load bearing bars are placed on top of the grating parallel to and between the primary load bearing bars. Shear members are vertically mounted on the tertiary load bearing bars to provide structural integrity. The interstices of the grating are filled to prevent concrete from penetrating the grating. A concrete overlay is poured and cured on the top surface of the grating and the interstice filling is removed.

15 Claims, 2 Drawing Sheets

EXODERMIC DECK CONVERSION METHOD

TECHNICAL FIELD

The present invention relates to a method of converting existing decks, roads, and sidewalks to an improved construction. More particularly, the present invention relates to converting existing open grid or concrete filled grid decks to an exodermic deck.

BACKGROUND OF THE INVENTION

The deterioration of bridges has been acknowledged as a critical safety problem in our Nation's transportation system. The rehabilitation and redecking of existing deficient structures, as well as designs for new structures, must cope with many factors affecting bridge construction and rehabilitation. These factors include increased usage, increased loading, reduced maintenance, and the need for lower costs, lighter weight, and more efficient construction techniques. The available deck systems heretofore used all have specific beneficial characteristics, but none have all of the features required to meet current needs.

Both open grid and filled grid decks are known and commonly used. Filled grating or grid allows concrete or similar material to fill or partially fill the interstices of the grating or grid. This results in an extremely heavy modular panel which is unwieldy and costly to construct and imposes undesirable dead load which serves no useful purpose in bridge deck construction. Open grating bridge decks without a concrete or similar filling are unacceptable for most situations because they are considered too dangerous to vehicular traffic and also dangerously allow objects to fall through the open grid surface.

U.S. Pat. Nos. 4,531,857 and 4,531,859 disclose a revolutionary new design for decks which has met all the above design factors. These patents disclose a prefabricated pavement module for bridges and the like and a method of making the module. The module includes a base grating and a concrete overlay. Studs are attached to the grating and extend into the concrete overlay. The studs transfer horizontal shear and provide a composite interaction between the grating and overlay. These grid decks are commonly known as exodermic decks.

An exodermic deck has section properties increased by 150% to 300% over that of known conventional grid deck constructions. An exodermic deck eliminates potential fatigue failure thereby providing a higher load capacity and extending the useful life of the existing grid deck. The exodermic deck relocates the neutral axis of the composite deck and reduces the maximum stress level in the top surface of the grid to a point at which fatigue failure should not occur. The exodermic deck system also eliminates the need for constant repair of broken grid bars and connections which is common with open grid deck installations. Moreover, an exodermic deck eliminates skidding and noise problems commonly associated with open grid deck bridges and with filled grid deck bridges which do not have a wearing surface above the grid. It is also significantly lighter than known filled or partially filled grid decks, which is highly desirable in bridge construction.

Exodermic decks are revolutionizing the bridge building industry. Exodermic decks may be used to replace worn out or damaged decks as well as to construct new bridges. In some instances, however, an existing grid deck is not worn out or damaged, but there is still a need or desire to convert the existing deck to an exodermic deck to realize the improved load capacity, wear life, and other benefits of an exodermic deck. Therefore, the problem exists of converting an existing filled, partially filled, or open grating grid deck, having a grating which is still useable, to an exodermic deck.

SUMMARY OF THE INVENTION

It is an object of the present invention to provide a method of converting an existing bridge grid deck to an exodermic deck.

It is a further object of this invention to extend the useful life of bridge decks, increase their load capacity, improve their safety, and reduce the need for repairs.

It is a further object of this invention to convert an existing bridge deck to an exodermic deck while still using the grating of the existing deck.

The present invention may be used on either open grid or filled grid deck bridges. On a filled grid deck, the "filling," usually concrete, must first be removed before conversion according to the invention can take place. Typically, a bridge deck includes a grating having a plurality of primary or main load bearing bars intersecting and interlocking with a plurality of secondary load bearing bars, or distribution bars. The distribution bars distribute load transverse to the primary load bearing bars. The grating has a top surface and a bottom surface. The grating is placed on a prepared surface of a road bed or on the structural framing of a bridge deck.

The method of the present invention includes removing existing concrete from the grating if the bridge has a concrete filled grating. A plurality of tertiary load bearing bars are installed between and parallel to the primary load bearing bars on the top surface of the grating. A plurality of shear connectors, such as vertical studs, are welded or otherwise attached to the top surface of the grating. Preferably, the shear connectors are essentially perpendicular to the grating. In a preferred form of the invention, the shear connectors are welded to the tertiary bars rather than the main bearing bars or distribution bars. Alternatively, the shear connectors may be integrally formed with the tertiary bars.

Reinforcing bars or mesh are placed on the top surface of the grating. Usually the reinforcing bars are epoxy coated. A concrete overlay having a planar top surface and a planar bottom surface is fixed to the top surface of the grating surrounding the reinforcing bars or mesh and the shear connectors. The planar bottom surface of the concrete overlay is substantially coplanar with the top surface of the grating.

The concrete is poured and cured so as not to fill the interstices of the grating. In a preferred embodiment, a form board is placed under the grating and the grating is filled with sand, plastic foam, or other material to prevent the concrete from filling the interstices of the grating. Upon pouring the concrete, the shear connectors and reinforcing bars become embedded within the concrete overlay. The shear connectors transfer horizontal shear and prevent vertical separation of the concrete wear member from the grating. The shear connectors pass into, but not through the concrete wear member.

After the concrete cures, the form board and sand or other filling is removed. A wear surface, such as conventional macadam, may be applied over the concrete overlay. The conventional deck has now been converted into an exodermic deck and enjoys all of the significant advantages of an exodermic deck.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention. Although particular reference is made to bridges or bridge decks in a preferred embodiment, it will be understood that the invention has broad application to other roadway or walkway surfaces.

DETAILED DESCRIPTION OF PREFERRED EMBODIMENTS

Figure 1:
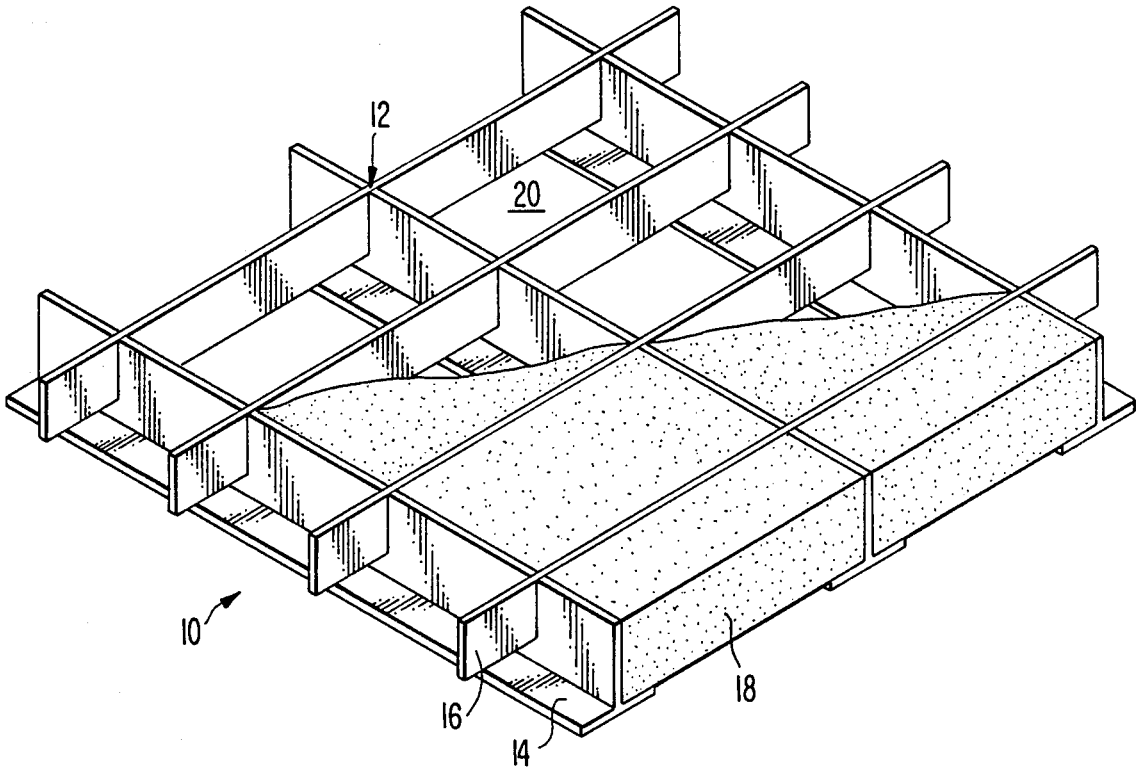
FIG. 1. (PRIOR ART)
FIG. 1 is a perspective view of a conventional, prior art, filled bridge deck.

As shown in FIG. 1, a conventional, prior art, filled bridge grid deck 10 comprises a grating 12 having main bearing bars 14 and distribution bars 16 intersecting and interlocking with main bearing bars 14. Distribution bars 16 distribute load transverse to main bearing bars 14. Grid deck 10 also includes a concrete fill 18 in the interstices 20 between main bearing bars 14 and distribution bars 16. Although concrete fill 18 is shown as completely filling interstices 20, it is also known that fill 18 may only partially fill interstices 20. Alternatively, it is also known that fill 18 may be omitted from certain grid decks, thereby providing an open grating. As discussed above, these known grid decks have a number of disadvantages.

The invention disclosed and claimed herein comprises a method for converting conventional grid deck 10 into an exodermic deck, generally indicated at 22. Converted or retrofitted deck 22 is intended to be formed in the field on a prepared road bed or on bridge floor framing members.

Converted deck 22 includes a preexisting base layer such as a conventional preexisting grid or grating 12, as shown in FIG. 1. Grating 12 may be made of metal, plastic, or any other suitable material, and may be galvanized, coated with an epoxy, or otherwise protected from deterioration. As is conventional, grating 12 is disposed on a supporting structure 8.

If grating 12 is filled or partially filled, the filling material is removed using any one of a number of known methods. In accordance with the present invention, tertiary load bearing bars 24 are mounted on and may be welded to top surface 26 of grating 12. Tertiary load bearing bars 24 are mounted between and parallel to main bearing bars 14. As shown, tertiary bars 24 may be fixed to distribution bars 16 by securing tertiary bars 24 within slots 28 in the top surface of distribution bars 16.

Shear members 30, such as studs 32, are vertically mounted to tertiary load bearing bars 24. Studs 32 may be welded to tertiary bars 24. Alternatively, studs 32 may be otherwise fixed to tertiary bars 24, or may be integrally formed with tertiary bars 24. Studs 32 extend upwardly above top surface 26 of grating 12. Studs 32 provide structural integrity to concrete overlay 36 and permit concrete overlay 36 and grating 12 to function in a complementary fashion.

Reinforcing bars 34 or a reinforcing mesh are placed on the top surface 26 of grating 12. Typically, the reinforcing bars are epoxy coated.

A form board (not shown) is placed under grating 12 to form a lower barrier and prevent the passage of material through interstices 20. Sand, plastic foam or other similar material is then applied to grating 12 to fill interstices 20 to a level substantially coplanar with the top surface 26 of grating 12. The form board prevents the sand or other material from falling through grating 12.

Figure 2:
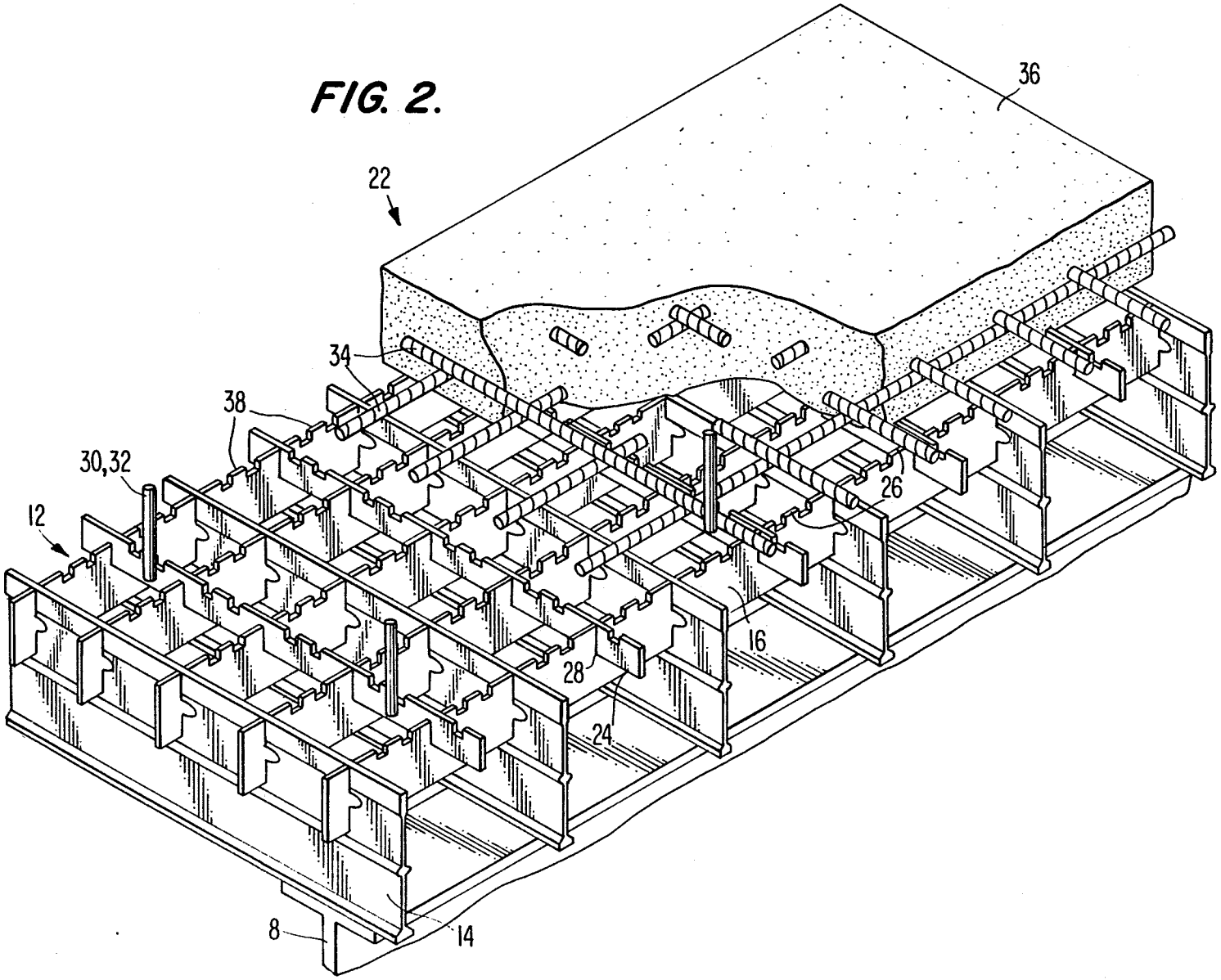
FIG. 2 is a perspective cutaway view of a bridge deck converted to an exodermic deck in accordance with the present invention.

A concrete overlay 36 is applied to the top surface 26 of grating 12 to envelop reinforcing bars 34. Studs 32 also are enveloped by concrete overlay 36, but do not protrude therethrough. The sand or other material filling interstices 20 prevents concrete overlay 36 from filling the interstices so that the bottom surface of concrete overlay 36 is substantially coplanar with the top surface 26 of grating 12. Preferably, the concrete overlay is a three inch thick structural concrete overlay. As shown in FIG. 2, the top surface of distribution bars 16 may be somewhat irregular, such as by having upwardly projecting tabs 38, which become embedded in concrete overlay 36.

After concrete overlay 36 has cured, the form board and sand or other material filling the interstices are removed. Studs 32 and tabs 38 (if used) are firmly fixed within overlay 36. They create a composite interaction between overlay 36 and grating 12 and serve to transfer horizontal shear between grating 12 and overlay 36. Studs 32 and tabs 38 (if used) also serve to prevent vertical separation of overlay 36 and grating 12.

A macadam or similar material wear surface (not shown) may be applied on top of overlay 36 if desired.

In the preferred embodiment, concrete overlay 36 is a high density low slump concrete, although other concrete formulations suitable as a wear surface may be used. High density concrete is preferable because it serves as an additional barrier to prevent moisture from reaching grating 12 and causing premature deterioration. A typical high density concrete would include approximately 31% each of coarse and fine aggregate; 6% air; 16% water; and 16% cement. A typical low slump is approximately ¾ inch. A latex modified concrete, as is well known in the art, could also be used as the top layer. In the preferred embodiment, the concrete layer should be aproximately three inches thick.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

I claim:

1. A method of converting to an exodermic traffic-bearing deck a grid deck comprising a preexisting traffic-bearing grating having a plurality of primary load bearing bars intersecting and interlocking with a plurality of secondary load bearing bars to distribute load transverse to said primary load bearing bars, said grating having a top surface and a bottom surface wherein said bottom surface is disposed on a supporting structure, comprising the steps of:

installing a plurality of tertiary load bearing bars between and parallel to said primary load bearing bars on said top surface of said grating;

installing a plurality of shear connectors on said top surface of said grating;

providing a concrete overlay fixed to and on top of said top surface of said grating enveloping said shear connectors, the bottom surface of said concrete overlay being substantially coplanar with said top surface of said grating so that said concrete does not fill the interstices of said grating; and curing said concrete overlay so that said shear connectors within said concrete overlay effect horizontal shear transfer and a composite interaction between said concrete overlay and said grating and prevent vertical separation between said concrete overlay and said grating.

2. A method as set forth in claim 1 further comprising the step of removing existing concrete from said grating.

3. A method as set forth in claim 1 further comprising the step of filling said grating interstices with a removable material to exclude said concrete overlay from the interstices.

4. A method as set forth in claim 3 wherein the step of filling said grating interstices further comprises placing a form board under said grating.

5. A method as set forth in claim 3 wherein said removable material comprises sand.

6. A method as set forth in claim 3 wherein said removable material comprises plastic foam.

7. A method as set forth in claim 1 further comprising welding said tertiary bars to said secondary load bearing bars.

8. A method as set forth in claim 1 wherein said shear connectors are studs fixed to said tertiary load bearing bars.

9. A method as set forth in claim 1 further comprising the step of placing reinforcing material on said top surface of said grating and enveloping said reinforcing material in said concrete overlay.

10. A method as set forth in claim 9 wherein said reinforcing material comprises reinforcing bars.

11. A method as set forth in claim 9 wherein said reinforcing material comprises mesh.

12. A method as set forth in claim 1 further comprising the step of applying a wear surface to the top of said concrete overlay.

13. A method as set forth in claim 12 wherein said wear surface comprises macadam.

14. A method of converting to an exodermic traffic-bearing deck a grid deck comprising a preexisting grating having a plurality of primary load bearing bars intersecting and interlocking with a plurality of secondary load bearing bars to distribute load transverse to said primary load bearing bars, said grating having a top surface and a bottom surface wherein said bottom surface is disposed on a supporting structure, said grating having its interstices filled with concrete, comprising the steps of:

removing any existing concrete from said grating;

installing a plurality of tertiary load bearing bars between and parallel to said primary load bearing bars on said top surface of said grating;

installing a plurality of shear connectors on said top surface of said grating;

placing reinforcing material on said top surface of said grating;

providing a concrete overlay fixed to and on top of said top surface of said grating enveloping said reinforcing material and said shear connectors, the bottom surface of said concrete overlay being substantially coplanar with said top surface of said grating; and curing said concrete overlay so that said shear connectors within said overlay effect horizontal shear transfer and a composite interaction between said concrete overlay and said grating and further prevent vertical separation between said concrete overlay and said grating.

15. A method as set forth in claim 11 further comprising the step of filling said grating interstices with a removable material to exclude said concrete overlay from the interstices.

* * * * *